US006068887A

United States Patent [19]

Isobe et al.

[11] Patent Number: 6,068,887

[45] **Date of Patent: *May 30, 2000**

[54] PROCESS FOR PRODUCING PLATED STEEL SHEET

[75] Inventors: Makoto Isobe; Chiaki Kato; Kazuhiro Seto, all of Chiba, Japan

[73] Assignee: Kawasaki Steel Corporation, Hyogo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/978,641

[22] Filed: Nov. 26, 1997

[51] Int. Cl.[7] ..... B05D 3/00; B05D 1/18; B23D 71/04

[52] U.S. Cl. ..... 427/433; 427/421; 427/329; 29/831.08; 72/202

[58] Field of Search ..... 427/436, 437, 427/433, 421, 327, 328, 329; 29/81.06, 81.08, 527.1, 527.6; 72/202

[56] References Cited

U.S. PATENT DOCUMENTS

| | | | |
|---|---|---|---|
| 4,745,786 | 5/1988 | Wakako et al. | 72/13 |
| 4,793,401 | 12/1988 | Matsuoka et al. | 164/476 |
| 5,433,796 | 7/1995 | Isobe et al. | 148/220 |
| 5,435,164 | 7/1995 | Di Giusto et al. | 72/202 |
| 5,853,503 | 12/1998 | Seto et al. | 148/320 |
| 5,878,966 | 3/1999 | Asakawa | 239/590 |

FOREIGN PATENT DOCUMENTS

| | | |
|---|---|---|
| 58-31035 | 2/1983 | Japan . |
| 4-304354 | 10/1992 | Japan . |
| 4-314847 | 11/1992 | Japan . |

*Primary Examiner*—Shrive Beck
*Assistant Examiner*—Jennifer L. Kolb
*Attorney, Agent, or Firm*—Young & Thompson

[57] ABSTRACT

A process for producing plated steel sheet comprises the steps of heating a steel slab containing not more than 0.5 wt % C to the temperature range not lower than the transformation point $Ac_3$, and jetting high-pressure water to the surface of a steel sheet at a discharge pressure of 300 kgf/cm$^2$ or more at least once during hot rough rolling and hot finish rolling, thereby removing a layer of iron oxide on the surface of the steel sheet. The steel sheet is thereafter coiled while keeping a finishing delivery temperature of the steel sheet in the range of 500–800° C., reducing the layer of iron oxide on the surface of the steel sheet at 50–98 % in an annealing furnace with the temperature of the steel sheet held in the range of 750–900° C., and plating the steel sheet. With the process of the invention, plated steel plates having superior workability and plating adhesion can be produced at low cost, even when cold rolling and pickling are omitted from the production steps.

10 Claims, No Drawings

PROCESS FOR PRODUCING PLATED STEEL SHEET

BACKGROUND OF THE INVENTION

1. Field of the Invention

The present invention relates to a process for producing plated steel sheets such as those used for building materials, air conditioners and hot water equipment, and automotive steel sheets, which require high strength, good drawing workability, and high corrosion resistance.

2. Description of the Related Art

Plated steel sheet is usually produced by the following steps. A slab is rolled into a steel sheet by hot rolling, and a layer of iron oxide (referred to as a scale hereinafter) generated on the surface of the steel sheet during the hot rolling is removed by pickling equipment. Then, after being subjected to cold rolling and recrystallization annealing depending on the quality required for the steel sheet under production, the steel sheet is coated with a plating layer by a continuous hot dipping apparatus or an electroplating apparatus, for example, thereby producing a plated steel sheet. In the above process, if the scale generated on the surface of the steel sheet during the hot rolling is not removed, the scale would impede the plating process by promoting peeling-off of the plating layer and decreasing plating adhesion (i.e., adhesion of the plating layer to the steel surface). Also, the process including the step of recrystallization annealing after cold rolling is effective in producing a steel sheet superior in workability such as elongation and drawing characteristics.

To improve the above-stated conventional process for producing plated steel sheet, various approaches have been attempted so far. For example, Japanese Unexamined Patent Publication No. 6-145937 and No. 6-279967 disclose a technique which omits the steps of pickling and cold rolling, primarily to lower the cost. Specifically, those Publications propose that a hot-rolled steel sheet be subjected to a reducing process in a reducing gas atmosphere gas without removing the scale on the surface of the hot-rolled steel sheet, following which the steel sheet is plated by hot zinc dipping. Also, Japanese Unexamined Patent Publication No. 9-143662 and No. 9-217160 disclose a method for improving adhesion of a plating layer to the scale by causing cracks in the scale on the surface of a steel sheet with a tension leveler or the like prior to the reducing process. However, none of the above Publications mention the deterioration of workability which may result from omission of the cold rolling step. Further, Japanese Unexamined Patent Publication No. 6-145937 includes no description about adhesion of the plating layer. Japanese Unexamined Patent Publication No. 6-279967 improves adhesion of the plating layer by using a hot-rolled steel sheet on which a thin scale is deposited to a thickness of 1.1–4.6 $\mu$m, but does not disclose a practical method for obtaining the thin scale. With the method disclosed in Japanese Unexamined Patent Publication No. 9-143662 and No. 9-217160, because cracks are generated in the scale prior to the reducing process, the adhesion force between the steel sheet and the scale is lowered, resulting in a danger that the scale may peel off during the reducing process and drop in the furnace or deposit on feed rollers, thus giving rise to flaws on the steel plate.

On the other hand, if steel of the type that contains an easily oxidized component such as Si and Mn is employed to increase the strength of plated steel sheet in the conventional production process, there arises a problem in that such an easily oxidized component becomes oxidized during annealing before the plating step, and is so concentrated on the surface of the steel sheet that the reaction between the steel sheet and the molten metal is impeded during the plating process and a bare spot results.

SUMMARY OF THE INVENTION

An object of the present invention is to provide a process for producing plated steel sheet at low cost without compromising high strength, workability and plating adhesion, even when pickling and cold rolling is omitted from the production steps of the plated steel sheet.

The inventors intensively studied the relation between temperature of hot rolling and working conditions, the relation between descaling conditions after rough rolling and scale thickness on a hot-rolled steel sheet, and material properties of the steel sheet after annealing. Also, the inventors repeatedly conducted experiments of reducing steel sheet, on the surface of which scale was generated, under various conditions, coating the steel sheet with plating layers, and examining characteristics of the plating layers. As a result, the inventors found that, even when cold rolling is omitted, deterioration of workability can be prevented by developing working strains incorporated in the hot-rolled steel sheet, and plating adhesion can be ensured by thinning the scale generated on the surface of the hot-rolled steel sheet without the need for removing the scale entirely.

Specifically, the process for producing plated steel sheet according to the present invention comprises the steps of heating a steel slab containing not more than 0.5 wt % carbon to a temperature range not lower than the transformation point $Ac_3$, ejecting high-pressure water to the surface of a steel sheet at a discharge pressure of at least about 300 kgf/cm$^2$ at least once during hot rough rolling and hot finish rolling, thereby removing a layer of iron oxide on the surface of the steel sheet, coiling the steel sheet while keeping the temperature of the steel sheet in the range not lower than about 500° C. but not higher than about 800° C. at the delivery side of final hot finish rolling, reducing the thickness of the layer of iron oxide on the surface of the steel sheet by at least about 50% but not more than about 98% in an annealing furnace with the temperature of the steel sheet held in the range not lower than 750° C. but not higher than 900° C., and plating the steel sheet.

Other features of the present invention, including variations thereof, will be apparent from the following detailed description.

DETAILED DESCRIPTION OF PREFERRED EMBODIMENTS

A process for producing plated steel sheet according to the present invention will be described below in detail according to the sequence of steps.

The process of the present invent on employs, as a material for a plated steel sheet, a steel slab containing not more than about 0.5 wt % C. Also, to obtain a plated steel sheet with high strength, the process of the present invention preferably employs a steel slab containing C in an amount of not less than about 0.02 Wt % but not more than about 0.5 wt %, Si not more than about 2 wt %, and Mn not more than about 3 wt %. On the other hard, to obtain a plated steel sheet with superior workability, the process of the present invention preferably employs a steel slab containing C in an amount less than about 0.02 wt %, Si not more than 2 wt %, Mn not more than 3 wt %, Ti not more than 0.2 wt %, Nb not more than 0.2 wt %, and N not more than 0.01 wt %, and meeting the formula (1) below:

$$[C]/12+[N]/14 \leq [Ti]/48+[Nb]/93 \quad (1)$$

The reasons why the components should be limited to the above respective ranges are as follows.

C: not more than 0.5 wt %; not less than 0.02 wt % but not more than 0.5 wt %; or, less than 0.02 wt %

C is an interstitial solid solution element, and it is effective in increasing the strength of the steel sheet, but lowers workability represented by elongation and r-value. In the present invention, therefore, the content of C is held down to not more than 0.5 wt % in the steel-making stage.

Further, in the present invention, the content of C is divided into the following two ranges for the purpose of decreasing the cost of the other alloy components.

First, a slab containing C not less than 0.02 wt % but not more than 0.5 wt % is used to obtain a plated steel sheet with high strength. A lower limit of C is set here to be not less than 0.02 wt % because this enables cementite to precipitate, whereby the plated steel sheet with high strength can be easily obtained at low cost. If the content of C is more than 0.5 wt %, deformation resistance of the plated steel sheet at high temperatures would be so high that a difficulty would be encountered in final finish rolling carried out at 800° C. or below to obtain a thin scale.

Secondly, a slab containing C less than 0.02 wt % is alternatively employed to obtain a plated steel sheet with superior workability. The C content is set to be less than 0.02 wt % in this case for the following reasons.

In order to obtain a plated steel sheet with superior workability, it is required to substantially eliminate free C in steel. A structure being in the form of a ferrite single-phase and having superior workability can be created by eliminating free C. Also, by precipitating and fixing a very small amount of C, deterioration of workability caused by aging etc. can be avoided. Further, although Ti and Nb are added in necessary amounts as explained in detail below, the addition of these components pushes up the cost and may develop the precipitate excessively. For the reason of avoiding such drawbacks, the content of C is set to be less than 0.02 wt %. A lower limit of C is not particularly set in this case, but the content of C is preferably not less than 0.0005 wt % for holding down the steel-raking cost.

The following components can be added depending on applications of the steel sheet.

Si: not more than 2 wt %, Mn: not more than 3 wt %

Si and Mn are components which serve to increase the strength of the steel sheet without impairing workability comparatively. These components can be added with upper limits set to 2 wt % and 3 wt %, respectively. If the content of each component exceeds the upper limit, cracks would likely occur in the edges of the steel sheet during hot working and the scale would generate so abnormally that the fine surface of the steel sheer would not be achieved. Lower limits of Si and Mn are not particularly set and can be adjusted depending on the strength required. For avoiding an increase in the steel cost, however, it is preferable that Si and Mn, have the lower limits of 0.001 wt % and 0.01 wt %, respectively.

N: not more than 0.01 wt %

N is adjusted to obtain a plated steel sheet with superior workability. The content of N is limited to not more than about 0.01 wt %. As with C, N is also an interstitial solid solution element. Thus N is effective in increasing the strength of the steel sheet, but lowers workability represented by elongation and r-value. In the present invention, therefore, the content of N is held down to not more than 0.01 wt % in the steel-making stage.

Ti: not more than 0.2 wt %, Nb: not more than 0.2 wt %

Ti and Nb are added to obtain a plated steel plate with superior workability. Ti and Nb serve to cancel off adverse effects on workability of C and N, when contained in steel in small amounts. Thus, addition of Ti and Nb causes C and N to precipitate through reaction, and ensures superior workability. It is practically important to add Ti not more than 0.2 wt % and Nb not more than 0.2 wt %, while meeting the formula (1) below with respect to the contents of C and N:

$$[C]/12+[N]/14 \leq [Ti]/48+[Nb]/93 \quad (1)$$

The reasons are that Ti is more reactive than Nb, in particular, and is selectively consumed in precipitation of N and C. Also, Ti is easily oxidized and consumed by oxygen in steel. Therefore, if the content of Ti is less than 0.01 wt %, the effect of the addition of Ti would not be developed. On the other hand, even if Ti is added in excess of 0.2 wt %, the effect would be saturated and the cost would be pushed up.

Nb is less reactive than Ti with other elements except C, and therefore develops the effect with addition in a small amount. However, if the content of Nb is less than 0.001 wt %, the number of Nb atoms is too small in comparison with the numbers of C and N atoms to develop the effect. On the other hand, even if Nb is added in excess of 0.2 wt %, the effect would be saturated and the cost would be pushed up.

Further, by adding Ti and Nb in the range to meet the above formula (1) depending on the contents of C and N, the amounts of Ti and Nb sufficient to precipitate C and N can be ensured.

Manufacturing conditions will now be explained.

Slap Heating Temperature: Not Lower Than Transformation Point $Ac_3$

In the hot rolling step, prior to the start of rough rolling, a steel slab containing the above components adjusted to fall within the respective ranges is heated to a temperature not lower than the transformation point $Ac_3$. Practically, the slab is heated to 1200° C. or thereabout so that deformation resistance of the steel sheet is reduced in the subsequent rough rolling step. Note that a slab which is cast by continuous casting or a like process may proceed directly to the rough rolling step before being cooled, without heating it again.

Hot Rough Rolling

After being heated to the predetermined temperature, the slab is subjected to rough rolling under ordinary rolling conditions by the use of a rough rolling mill comprising a plurality of stands.

Hot Finish Rolling

After the rough rolling, the steel sheet is subjected to finish rolling under ordinary rolling conditions by the use of a finish rolling mill comprising a plurality of stands. The rolled steel sheet is coiled while keeping a finishing delivery temperature of the steel sheet in the range not lower than 500 ° C. but not higher than 800° C. The reason for keeping the finishing delivery temperature of the steel sheet not lower than 500° F. is that if the steel sheet temperature is lower than 500° C., the steel sheet would be too hard to undergo rolling. On the other hand, the reason for keeping the finishing delivery temperature of the steel sheet not higher than 800° C. is to suppress the scale from growing immediately after the hot rolling. Specifically, by keeping the steel sheet temperature in the above range, a thickness of the scale on the hot-rolled steel sheet can be suppressed to the order of 4 $\mu$m or below.

In order to obtain a plated steel sheet with high strength, it is important in the case of employing a steel slab containing C not less than 0.02 wt % but not more than 0.5 wt %, Si not more than 2 wt %, and Mn not more than 3 wt % that the hot finish rolling be performed while tension is applied to the steel sheet under the hot finish rolling at the leading and tailing ends thereof. The reason for applying tension is that, when such a steel composition having a relatively high content of C is subject to finish rolling at low temperatures, deformation resistance of the steel sheet is large and the depressing force becomes excessive. This makes the rolling uneven and leads to a failure in configuration of the steel sheet such as caused by drawing. By rolling the steel sheet while uniform tension is applied to it under finish rolling, such a failure in configuration of the steel sheet can be avoided. A method for applying tension to the steel sheet under the hot finish rolling at the leading and tailing ends thereof can be realized by interconnecting the tailing end of one steel sheet or slab to the leading end of a next steel sheet or slab beforehand by welding or pressure welding, and then performing continuous rolling. This method enables uniform tension to be applied to the steel sheet under the finish rolling.

Further, in order to obtain a plated steel sheet with superior workability, it as important in the case of employing a steel slab containing C less than 0.02 wt %, Si not more than 2 wt %, Mn not more than 3 wt %, Ti not more than 0.2 wt %, Nb not more than 0.2 wt %, and N not more than 0.01 wt %, and meeting the above formula (1) that the hot finish rolling is performed in the temperature range not higher than the transformation point $Ar_3$ at a reduction ratio of 60% or more, and the rolled steel sheet is coiled while the finishing delivery temperature of the steel sheet is kept in the range not lower than 500° C. but not higher than 800° C. The reason for performing the hot finish rolling in the temperature range not higher than the transformation point $Ar_3$ at a reduction ratio of 60% or more is to develop recrystallization in the ferrite single-phase region, thereby providing a steel sheet with superior workability. In other words, recrystallization during the reducing process in a reducing furnace creates a structure advantageous in providing high workability. Consequently, superior workability can be ensured without cold rolling.

Descaling By High-Pressure Water: Discharge Pressure of 300 kgf/cm$^2$ or More

Usually, cooling water is jetted to the surface of the steel sheet at a discharge pressure of 150 kgf/cm$^2$ or less during the hot rough rolling and the hot finish rolling. With the process of the present invention, in addition to such conventional water jet, high-pressure water is jetted to the surface of the steel sheet at a discharge pressure of 300 kgf/cm$^2$ or more at least once during the steps of hot rough rolling and hot finish rolling, thereby removing the scale generated on the surface of the steel sheet. In this case, it is preferred that the descaling with high-pressure water be performed after the rough rolling but prior to the finish rolling. It is also important to jet the high-pressure water to the surface of the steel sheet all over the sheet width. The reason for jetting the high-pressure water at discharge pressure of 300 kgf/cm$^2$ or more is to efficiently and almost completely remove the scale, which has grown until the end of the rough rolling, without causing flaws on the surface of the steel sheet. If the discharge pressure is lower than 300 kgf/cm$^2$, the scale would not be completely removed, resulting in the scale on the surface of the hot-rolled steel sheet after the finish rolling and coiling being excessively thick and uneven. By carrying out the descaling with the high-pressure water to thin the thickness of the oxide scale, the surface of the hot-rolled steel sheet can be made fine. Further, a plated steel sheet having good plating adhesion and a fine surface can be produced by performing the reducing process in a heating furnace of a continuous hot dipping apparatus with no need of additional descaling by pickling.

On the contrary, when plating is performed on a hot-rolled steel sheet having a thick oxide scale and being poor in surface properties which has been produced by the conventional process including no descaling with the high-pressure water, it is difficult to produce a plated steel sheet having good plating adhesion and a fine surface unless the descaling by pickling is made. To achieve effective descaling with the high-pressure water, the distance between a nozzle and the steel sheet is preferably held in the range of about 80 mm to about 250 mm. Also, the amount of the jetted water is preferably set to be at least about 1 cm$^3$ per 1 cm$^2$ of area.

Annealing and Reducing Process

When the hot-rolled steel sheet is coiled and then plated by hot dipping, it is subject to recrystallization annealing and reduction at the same time in an annealing furnace of the continuous hot dipping apparatus, followed by plating. In other words, the annealing furnace of the continuous hot dipping apparatus functions to reduce the scale and simultaneously develop recrystallization in the steel sheet.

For expediting both the reactions, the steel sheet is required to be reduced at a temperature not lower than 750° C. but not higher than 900° C. This is because if the temperature is lower than 750° C., the reaction speed would be reduced, and if the temperature is higher than 900° C., the structure would be too rough and coarse or random to develop a structure advantageous from the viewpoint of workability.

Additionally, in order to obtain a plated steel sheet with superior workability, it is required in the case of employing a steel slab containing C less than 0.02 wt %, Si not more than 2 wt %, Mn not more than 3 wt %, Ti not more than 0.2 wt %, Nb not more than 0.2 wt %, and N not more than 0.01 wt %, and meeting the above formula (1) that the plating be carried out after reducing the steel sheet in the annealing furnace at a temperature not lower than 750° C. and not higher than the lower of 900° C. and the transformation point Acs.

The reasons for setting an upper limit of the reducing temperature in the annealing furnace to a temperature not higher than the lower of 900° C. and the transformation point Acs is as follows.

In the case of providing a plated steel sheet with superior workability, if the reducing temperature is higher than the lower of 900° C. and the transformation point Acs, the steel sheet would be too soft to keep stability in passing of the steel sheet through the furnace. Also, crystal grains would be apt to become coarse. Once the crystal grains become coarse, irregularities would occur on the surface of the steel sheet during working. An improvement of workability requires recrystallization to be developed in the ferrite single-phase region. To this end, it is necessary to perform the annealing at a temperature not higher than the transformation point Acs. For those reasons, the upper limit of the reducing temperature is set to a temperature not higher than the lower of 900° C. and the transformation point Acs.

Further, the scale should be reduced to an extent of not less than 50% but not more than 98%. The reasons are below. If the reduction is less than 50%, the scale would remain in so large an amount as to peel off upon receiving impacts or being subjected to working, and the steel sheet would not be durable for practical use. On the other hand, if the reduction is more than 98%, occlusion of hydrogen atoms into steel would begin. If hydrogen atoms are occluded excessively, hydrogen would be discharged from the steel after the plating and vaporized at the interface of a plating layer because of no place to escape, thereby causing local peeling-off of the plating layer. For the steel sheet containing Si and Mn in high density, in particular, if the reduction is more than 98%, oxidation of Si and Mn would give rise to enrichment of the precipitates on the surface of the steel sheet and the steel sheet would fail to develop a wetting property in the subsequent plating step, resulting in a defect of bare spot.

Note that although $N_2$ containing $H_2$, not less than 3%, which is a general reducing gas, can be used as a reducing atmosphere, the $H_2$ concentration is preferably not less than 7% from the point of achieving efficient reduction.

Plating

After the completion of the steps of reducing and recrystallization annealing performed in a predetermined manner, the steel sheet is subjected to plating by being cooled down to a temperature as low as the temperature of a plating bath and then put into the plating bath, by way of example, in the case of hot dipping. A zinc-based plating bath may contain not only Zn and Fe, but also Al, Mg, Mn, Ni, Co, Cr, Si, Pb, Sb, Bi, Sn end so forth either alone or in combination for the purpose of improving various properties.

Finally, the steel sheet having been plated by hot dipping is adjusted to have a required reposition in the range of 20 to 250 g/m$^2$ by gas wiping or the like, followed by cooling with natural radiation, air or water. The steel sheet is then obtained as a product after being passed through a leveler or a refining rolling stand if necessary. To improve corrosion resistance, for example, the steel sheet may be subjected to chromate or phosphate treatment etc. after the cooling or the refining rolling. Alternatively, painting the steel sheet is also effective for that purpose. Additionally, lubrication treatment may also be performed as post-treatment on the steel sheet.

On the other hand, in an application where steel sheet is assembled into a structure by spot resistance welding etc., it is effective to perform the plating in a molten Zn bath which contains Al in the range of 0.1 to 0.2 wt %, adjust a deposition of the plating material, and then develop the alloying process under heating. If the deposition of the plating material is less than 20 g/m$^2$, corrosion resistance would be insufficient, and if it exceeds 80 g/m$^2$, the plating layer would be apt to peel off when the plated steel sheet is subject to working such as bending and drawing. Therefore, the deposition of the plating material is preferably held in he range of 20 to 80 g/m$^{2.}$ Also, the content of Fe in the plating layer is set to fall in the range of 7 to 12 wt %. The reason is that if the content of Fe is less than 7 wt %, a layer of pure Zn not yet alloyed would remain on the surface of the plating layer to impede a spot resistance welding property and the pure Zn layer would be apt to effuse from flaws etc. after painting, and that if the content of Fe is more than 12 wt %, the plating layer would become brittle so quickly as to peel off remarkably during working.

While the above description has be n made primarily of the case of producing steel sheets plated by hot zinc dipping, the present invention is also likewise applicable to steel sheets plated by other types of hot dipping or electroplating. For example, 55%—Zn plating, Al plating, Pb plating, Sn plating, and Zn—Ni plating can be used to produce plated steel sheets by the process of the present invention. In any case, by plating steel sheets which have been subject to the reducing process at a reducing rate not less than 50% but not higher than 98%, the steel sheet having superior plating characteristics can be obtained regardless of the type of plating. Since a plating tank is usually arranged in continuation to the annealing furnace in a hot zinc dipping line, the present invention is especially suitable for such a line.

EXAMPLE

Slabs having steel compositions shown in Table 1 were heated to 1200° C. and subjected to normal rough rolling. Then, the tailing end of one slab was connected to the leading end of a next slab by welding. After that, descaling and continuous hot rolling were performed on the slabs under the conditions shown in Table 2, whereby hot-rolled steel sheet with a thickness of 0.8 mm were obtained. In the finish rolling step, the steel sheet was lubricated by mineral oil. Also, as conventional examples, cold-rolled steel sheet was produced by performing pickling and cold rolling under the conditions shown in Table 3 after the hot rolling step.

Then, hot- and cold-rolled steel sheet was cut off into test pieces of 60×200 mm and rinsed with acetone. Subsequently, the test pieces were subjected to reduction and recrystallization annealing by a hot metal dipping simulator of vertical type, followed by zinc-based plating. Table 2 lists the conditions of descaling, hot rolling and annealing, as well as the stale thickness of each of the hot-rolled steel shet. Table 3 lists the conditions of hot rolling, cold rolling and annealing employed in the conventional examples. Further, Table 4 lists the conditions of plating. For each of the plated steel sheet thus prepared, a scale reducing rate was measured and, mechanical characteristics and plating adhesion were evaluated. The results of the scale reducing rate and the mechanical characteristics were listed in Tables 2 and 3, and the evaluated results of the plating adhesion were listed in Table 4. The scale reducing rate was measured by separately determining the amount of the scale dissolved and removed by pickling beforehand, calculating the amount of reduced iron oxide from the weight of the scale decreased by being subject to the reducing and annealing process under the same plating conditions, and obtaining a ratio between the two amounts.

The plating adhesion was evaluated by conducting the ball impact test and the 180°-outward bending test. More specifically, the ball impact test was made by holding a hammer pin, which had a hemispherical convex surface with a diameter of ½, against the rear side of the plated steel sheet opposite to the surface to be tested, placing a bearing saucer, which had a hemispherical concave shape, against the surface to be tested, dropping a weight of 2 kg from the height of 70 cm to hit upon the hammer pin, sticking a cellophane adhesive tape to the projected surface to be tested and then peeling off the tape, and observing the surface of the plated steel sheet. Also, the 180°-outward bending test was made by sticking a vinyl adhesive tape to the surface of the plated steel sheet to be tested, setting the steel sheet of 0.8 mm in a spacer, bending the steel sheet 180 degrees by hydraulic press with the surface to be tested facing outward, re-bending the bent steel sheet back to a flat state, peeling off the vinyl tape, and observing the surface of the plated steel sheet.

TABLE 1

| Steel type | C | Si | Mn | P | S | Al | N | Ti | Nb | *X-value | Remarks |
|---|---|---|---|---|---|---|---|---|---|---|---|
| | (wt %) | | | | | | | | | | |
| A | 0.25 | 0.01 | 0.52 | 0.01 | 0.01 | 0.04 | — | — | — | — | Inventive example |
| B | 0.08 | 0.10 | 1.8 | 0.08 | 0.01 | 0.05 | — | — | — | — | Inventive example |
| C | 1.2 | 0.01 | 0.05 | 0.06 | 0.08 | 0.02 | — | — | — | — | Comparative example |
| D | 0.0035 | 0.96 | 0.62 | 0.121 | 0.005 | 0.044 | 0.001 | 0.048 | 0.003 | 0.000669 | Inventive example |
| E | 0.0025 | 0.14 | 1.71 | 0.119 | 0.006 | 0.049 | 0.002 | 0.039 | 0.007 | 0.000525 | Inventive example |
| F | 0.0021 | 0.02 | 0.53 | 0.061 | 0.006 | 0.043 | 0.002 | 0.041 | 0.008 | 0.000622 | Inventive example |
| G | 0.0039 | 0.26 | 1.23 | 0.148 | 0.007 | 0.041 | 0.001 | 0.052 | 0.005 | 0.000741 | Inventive example |

*X = [Ti]/48 + [Nb]/93 − [C]/12 − [N]/14

TABLE 2-1

| No | Steel type | Descaling water pressure (kg/cm$^2$) | *Rolling mode | Finishing delivery temperature (C. °) | Reduction ratio below $Ar_3$ (%) | Coiling temperature (C. °) | Scale thickness (μm) | Reducing/Annealing process $H_2$ (%) | Temp. (C. °) | Time (S) | **Scale reducing rate (%) | TS (MPa) | ***Elongation (%) | ***r-value | Remarks (Examples) |
|---|---|---|---|---|---|---|---|---|---|---|---|---|---|---|---|
| 1 | A | 450 | Cont.* | 750 | — | 610 | 3.0 | 20 | 820 | 40 | 71 | 420 | 32 | 0.6 | Inventive |
| 2 | A | 350 | Single | 760 | — | 610 | 3.0 | Rear end of steel sheet was drawn | | | | | | | ****Comp. |
| 3 | B | 450 | Cont.* | 750 | — | 450 | 3.5 | 20 | 820 | 40 | 71 | 500 | 28 | 0.7 | Inventive |
| 4 | B | 100 | Cont.* | 750 | — | 450 | 5.5 | 20 | 820 | 40 | 45 | 500 | 28 | 0.7 | ****Comp. |
| 5 | B | 350 | Cont.* | 760 | — | 620 | 3.8 | 20 | 730 | 40 | 39 | 530 | 24 | 0.6 | ****Comp. |
| 6 | B | 350 | Cont.* | 900 | — | 600 | 8.8 | 20 | 820 | 40 | 28 | 570 | 25 | 0.8 | ****Comp. |
| 7 | B | 350 | Cont.* | 450 | — | 350 | 1.3 | Incapable of rolling steel sheet to thickness of 0.8 mm | | | | | | | ****Comp. |
| 8 | C | 350 | Cont.* | 750 | — | 600 | 4.2 | Cracks occurred in edges of steel sheet | | | | | | | ****Comp. |
| 9 | D | 450 | Cont.* | 750 | 75 | 610 | 2.9 | 20 | 820 | 40 | 71 | 500 | 30 | 1.4 | Inventive |
| 10 | D | 250 | Cont.* | 820 | 30 | 610 | 5.5 | 20 | 820 | 60 | 45 | 480 | 33 | 1.2 | ****Comp. |

TABLE 2-2

| No | Steel type | Descaling water pressure (kg/cm$^2$) | *Rolling mode | Finishing delivery temperature (C. °) | Reduction ratio below $Ar_3$ (%) | Coiling temperature (C. °) | Scale thickness (μm) | Reducing/Annealing process $H_2$ (%) | Temp. (C. °) | Time (S) | **Scale reducing rate (%) | TS (MPa) | ***Elongation (%) | ***r-value | Remarks (Examples) |
|---|---|---|---|---|---|---|---|---|---|---|---|---|---|---|---|
| 11 | D | 350 | Cont.* | 760 | 75 | 620 | 3.1 | 20 | 730 | 60 | 39 | 540 | 27 | 1.0 | ****Comp. |
| 12 | E | 350 | Cont.* | 760 | 75 | 620 | 3.6 | 20 | 820 | 40 | 68 | 460 | 41 | 1.8 | Inventive |
| 13 | F | 350 | Cont.* | 760 | 75 | 620 | 3.6 | 20 | 820 | 40 | 68 | 370 | 41 | 1.7 | Inventive |
| 14 | F | 150 | Cont.* | 780 | 65 | 600 | 6.2 | 20 | 820 | 40 | 42 | 360 | 42 | 1.6 | ****Comp. |
| 15 | F | 350 | Cont.* | 930 | 0 | 680 | 9.5 | 20 | 820 | 40 | 27 | 350 | 43 | 1.0 | ****Comp. |
| 16 | G | 350 | Cont.* | 750 | 75 | 590 | 2.7 | 20 | 820 | 40 | 68 | 510 | 31 | 1.4 | Inventive |

*Rolling mode: In Cont.* (continuous) mode, tension was applied to steel sheets by interconnecting the steel sheets and performing continuous hot finish rolling on the connected steel sheets. In single mode, slabs were subject to hot finish rolling one by one and hence no tension was applied to steel sheets.

**Scale reducing ratio was measured by separately determining the amount to scale removed by pickling beforehand, calculating the amount of reduced iron oxide from the weight of scale decreased by being subject to reducing and annealing under the same conditions, and obtaining a ratio therebetween.

***Material properties of steel sheet was measured from tests made after plating.

****Comp. means comparative example. (And "Inventive" means inventive example.)

TABLE 3

| No. | Steel type | Finishing Delivery temperature (C. °) | Coiling temperature (C. °) | Removal of scale | Cold rolling reduction ratio (%) | Reducing/Annealing process $H_2$ (%) | Temp. (C. °) | Time (S) | TS (MPa) | *Elongation (%) | *r-value (%) | Remarks |
|---|---|---|---|---|---|---|---|---|---|---|---|---|
| 17 | B | 900 | 600 | Pickling | 65 | 20 | 820 | 40 | 570 | 25 | 0.7 | Conventional example |
| 18 | G | 930 | 680 | Pickling | 75 | 20 | 820 | 40 | 500 | 31 | 1.6 | Conventional example |

*Material properties of steel sheet was measured from tests made after plating.

TABLE 4

| No. | Plating bath Composition | Plating bath Temp. (C. °) | Plating time (S) | Deposition ($g/m^2$) | Plating appearance | *Result of ball impact test | **Result of 180°-outward bending test | ***Overall evaluation of steel sheet | Remarks |
|---|---|---|---|---|---|---|---|---|---|
| 1 | Zn-5% Al | 460 | 3 | 60 | Good | 1 | 1 | ⊙ | Inventive example |
| 3 | Zn-5% Al | 460 | 3 | 120 | Good | 1 | 1 | ⊙ | Inventive example |
| 4 | Zn-5% Al | 460 | 3 | 120 | Good | 3 | 3 | Δ | Comparative example |
| 5 | Zn-0.2% Al | 460 | 3 | 120 | Good | 3 | 3 | Δ | Comparative example |
| 6 | Zn-0.2% Al | 460 | 3 | 120 | Good | 3 | 3 | Δ | Comparative example |
| 9 | Zn-0.2% Al | 460 | 3 | 60 | Good | 1 | 1 | ⊙ | Inventive example |
| 10 | Zn-0.2% Al | 460 | 3 | 60 | Good | 3 | 2 | Δ | Comparative example |
| 11 | Zn-0.2% Al | 460 | 3 | 220 | Good | 3 | 3 | Δ | Comparative example |
| 12 | Zn-0.2% Al | 460 | 3 | 120 | Good | 1 | 1 | ⊙ | Inventive example |

TABLE 4-2

| No. | Plating bath Composition | Plating bath Temp. (C. °) | Plating time (S) | Deposition ($g/m^2$) | Plating appearance | *Result of ball impact test | *Result of 180°-outward bending test | **Overall evaluation of steel sheet | Remarks (Examples) |
|---|---|---|---|---|---|---|---|---|---|
| 13 | Zn-5% Al | 460 | 3 | 120 | Good | 1 | 1 | ⊙ | Inventive |
| 14 | Zn-5% Al | 460 | 3 | 120 | Good | 3 | 3 | Δ | Comparative |
| 15 | Zn-5% Al | 460 | 3 | 90 | Good | 4 | 3 | Δ | Comparative |
| 16 | Zn-5% Al | 460 | 3 | 90 | Good | 1 | 1 | ⊙ | Inventive |
| 17 | Zn-0.2% Al | 460 | 3 | 90 | | 3 | 3 | x | Conventional |
| 18 | Zn-0.2% Al | 460 | 3 | 60 | | 2 | 1 | x | Conventional |

*In ball impact test and 180°-outward bending test, plating adhesion was evaluated by ratings below after repeating steps of sticking and peeling a tape subsequent to the test: (excellent) 1: no change on the plating surface 2: small fluff was found in tested area of the plating surface 3: peel-off occurred in small part of tested area of the plating surface (poor) 4: large part of tested area of the plating surface peeled off

**Overall evaluation of steel sheet: (excellent) ⊙ plating is good and material properties meet TS > 400 MPa or r > 1.3 Δ plating adhesion force is insufficient or material properties meet neither TS > 400 MPa nor r > 1.3 (poor) x As will be apparent from Tables 1 to 4, all of the plated steel sheets produced according to the process of the present invention have the desired characteristics and are superior in plating adhesion. Steel sheet samples Nos. 1 and 3 produced respectively from slabs of steel types A, B in accordance with the manufacturing conditions of the present invention have TS in excess of 400 MPa and are superior in both strength and plating adhesion. Steel sheet samples Nos. 9, 12, 13 and 16 produced respectively from slabs of steel types D, E, F and G in accordance with the manufacture conditions of the present invention have the r-values in excess of 1.3 and are superior in both workability and plating adhesion.

On the contrary, it is understood that samples Nos. 2, 4, 5, 6, 7, 8, 10, 11, 14 and 15 as comparative examples and samples Nos. 17 and 18 as conventional examples, which are outside the scope of the present invention in component composition and/or manufacturing conditions, cannot provide steel sheets of satisfactory mechanical characteristics and, even if possible, the resulting steel sheets have poor plating adhesion.

According to the present invention, as described above, plated steel sheets having high strength, good drawing workability, high corrosion resistance, and superior plating adhesion can be produced by omitting the step of removing the scale. In addition, since pickling and cold rolling can be omitted from the production steps of the plated steel sheets, the plated steel sheets can be produced at low cost.

Although the present invention has been described in connection with various preferred embodiments thereof, it will be understood by those skilled in this art that those embodiments are described solely for purposes of illustrating the present invention, and should in no way be construed in a limiting sense. Instead, various modifications and substitutions of equivalent techniques will be readily apparent to those skilled in this art after reading the foregoing specification, and all such modifications and substitutions are to be understood as falling within the true scope and spirit of the appended claims.

What is claimed is:

1. A process for producing plated steel sheet comprising the steps of:

heating a steel slab containing not more than about 0.5 wt % C, not more than about 2 wt % Si and not more than about 3 wt % Mn to a temperature range not lower than a transformation point $Ac_3$ of said steel slab;

jetting high-pressure water on a surface of a steel sheet rolled from said steel slab at a discharge pressure of at least about 300 kgf/cm$^2$ at least once during hot rough rolling and hot finish rolling, thereby at least partially removing a layer of iron oxide on the surface of said steel sheet;

coiling said steel sheet while keeping the temperature of said steel sheet in a finishing delivery temperature range from at least about 500° C. to at most about 800° C. so as to have a scale thickness of not less than about 2.7 $\mu$m generated on the surface of the steel sheet; and reducing the thickness of the layer of iron oxide on the surface of said steel sheet at percentage not lower than 50% but not higher than 98% in an annealing furnace with the temperature of said steel sheet held in the range not lower than 750° C. but not higher than 900° C., and plating said steel sheet.

2. The process according to claim 1, wherein a steel slab containing C not less than 0.02 wt % but not more than 0.5 wt %, Si not more than 2 wt %, and Mn not more than 3 wt % is used, and the hot finish rolling is performed while tension is applied to said steel sheet under the hot finish rolling at the leading and tailing ends thereof.

3. The process according to claim 1, wherein a steel slab containing C less than 0.02 wt %, Si not more than 2 wt %, Mn not more than 3 wt %, Ti not more than 0.2 wt %, Nb not more than 0.2 wt %, and N not more than 0.01 wt %, and meeting the formula (1) shown below is used, the hot finish rolling is performed in the temperature range not higher than the transformation point $Ar_3$ at a reduction ratio of 60% or more, the hot-rolled steel sheet is coiled and then reduced in an annealing furnace at a temperature not lower than 750° C. but not higher than lower one of 900° C. and the transformation point Acs, and said plating step is performed:

$$[C]/12+[N]/14 \leqq [Ti]/48+[Nb]/93 \quad (1).$$

4. The process according to claim 1, wherein said jetting step comprises jetting said high pressure water from at least one nozzle maintained at a distance from said steel sheet of about 80 mm to about 250 mm.

5. The process according to claim 1, therein said jetting step comprises jetting said high-pressure water in an amount of at least about 1 cm$^3$ per 1 cm$^2$ of area of said steel sheet.

6. The process according to claim 1, wherein, in said jetting step, high-pressure water is jetted to the surface of said steel sheet all over the sheet width at a discharge pressure of 300 kgf/cm$^2$ or more at least once after the end of hot rough rolling but prior to the start of hot finish rolling.

7. The process according to claim 1, wherein said plating step is performed by hot dipping.

8. The process according to claim 7, wherein said hot dipping is performed by hot zinc dipping.

9. The process according to claim 8, wherein alloying treatment is performed subsequent to the hot zinc dipping in order to improve the properties of the steel sheet.

10. The process according to claim 8, wherein said hot zinc dipping is carried out in a zinc-based plating bath containing Zn and Fe, and at least one element selected from the group consisting of Al, Mg, Ni, Co, Cr, Si, Pb, Sb, Bi, Sn and mixtures thereof.

* * * * *